US008937238B1

(12) United States Patent
Sato et al.

(10) Patent No.: US 8,937,238 B1
(45) Date of Patent: Jan. 20, 2015

(54) MUSICAL SOUND EMISSION APPARATUS, ELECTRONIC MUSICAL INSTRUMENT, MUSICAL SOUND EMITTING METHOD, AND STORAGE MEDIUM

(71) Applicant: Casio Computer Co., Ltd., Shibuya-ku, Tokyo (JP)

(72) Inventors: Hiroki Sato, Nishi-Tokyo (JP); Hajime Kawashima, Akishima (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 14/324,489

(22) Filed: Jul. 7, 2014

(30) Foreign Application Priority Data

Jul. 11, 2013 (JP) ..... 2013-145530

(51) Int. Cl.
*G10H 1/02* (2006.01)
*G10H 7/00* (2006.01)
*G10H 1/04* (2006.01)

(52) U.S. Cl.
CPC ..... *G10H 1/04* (2013.01)
USPC ..... 84/628

(58) Field of Classification Search
CPC ..... G10H 2210/225
USPC ..... 84/628
See application file for complete search history.

(56) References Cited

U.S. PATENT DOCUMENTS 5,403,971 A * 4/1995 Aoki ..... 84/626
6,376,759 B1 * 4/2002 Suzuki ..... 84/615
7,271,331 B2 * 9/2007 Lindemann ..... 84/628

FOREIGN PATENT DOCUMENTS

JP 2009053432 A 3/2009
JP 5056270 B2 10/2012

* cited by examiner

*Primary Examiner* — Jeffrey Donels
(74) *Attorney, Agent, or Firm* — Holtz, Holtz, Goodman & Chick PC

(57) ABSTRACT

A CPU sets a first key-press pitch as a first target value; sets the immediately-preceding key-press pitch as a first starting point; emits the first key-press pitch sound therefrom with portamento toward the first target value; sets the second key-press pitch as a second target value; sets a pitch obtained by adding a pitch difference between the first and second key-press pitches to the pitch of the above-described sound as a second starting point; emits the second key-press pitch sound therefrom with portamento toward the second target value; sets the third key-press pitch as a third target value; sets a pitch obtained by adding a pitch difference between the second and third key-press pitches to the pitch of the sound being emitted with portamento toward the second target value as a third starting point; and emits the third key-press pitch sound therefrom with portamento toward the third target value.

19 Claims, 8 Drawing Sheets

PRIOR ART

PRIOR ART

PRIOR ART

MUSICAL SOUND EMISSION APPARATUS, ELECTRONIC MUSICAL INSTRUMENT, MUSICAL SOUND EMITTING METHOD, AND STORAGE MEDIUM

CROSS-REFERENCE TO RELATED APPLICATION

This application is based upon and claims the benefit of priority from the prior Japanese Patent Application No. 2013-145530, filed Jul. 11, 2013, the entire contents of which are incorporated herein by reference.

BACKGROUND OF THE INVENTION

1. Field of the Invention

The present invention relates to a musical sound emission apparatus, an electronic musical instrument, a musical sound emitting method, and a storage medium for actualizing polyphonic portamento by which a pitch change can be made with pitch differences among constitutive notes of a played chord being maintained.

2. Description of the Related Art

Conventionally, musical sound emission apparatuses with a portamento function have been known. The portamento function is a function for causing a change from the pitch of a sound being emitted by a previous key press (staring point) to smoothly reach the pitch of a sound to be emitted by a current key press (target value). In one known musical sound emission apparatus, the change speed for portamento is set constant irrespective of a pitch difference between the starting point and the target value, or set according to the pitch difference between the starting point and the target value, whereby the time for portamento is kept constant.

For example, in a technique disclosed in Japanese Patent Application Laid-Open (Kokai) Publication No. 2009-053432, a portamento speed r is calculated according to a standard portamento rate R when a pitch difference is a semitone, a pitch difference T between a starting-point pitch and a target pitch, and an interval dependency coefficient K representing the degree of dependency of the pitch difference I on the portamento speed r. The calculated portamento speed r is added to a current pitch for each predetermined cycle, and the sound is continuously changed to the target pitch. When a quick phrase is being played, the interval dependency coefficient K is set so that portamento is constant in time as much as possible in order to prevent the pitch of the phrase from being delayed. When a slow phrase is being played, the interval dependency coefficient K is set so that the portamento speed is constant. As a result, an optimum portamento effect is provided.

However, the technique disclosed in the above-described Japanese Patent Application Laid-Open (Kokai) Publication No. 2009-053432 is intended for monophonic (sound emission of a single note), and therefore has the following problems in the case of polyphonic (sound emission of a plurality of notes) portamento by chord performance.

In polyphonic portamento, when a plurality of keys are pressed by chord performance, the pitch of a sound emitted by a previous key press is taken as a starting point, and a pitch change is made to the pitch of a sound to be emitted by a current key press. This polyphonic portamento is described with reference to FIG. 6. FIG. 6 is a diagram depicting the positions of a previous key press and a current key press performed on a key board, previous key-press timing, and current key-press timing.

In the example of FIG. 6, the sound of the key of a pitch C1 is emitted, and then a current cord performance of "C major" is performed by the keys of constitutive notes "C4 note", "E4 note", and "G4 note" being pressed in sequence. Here, first, as for the key press of "C4 note", the C1 note is taken as a starting point of the C4 key press, and the pitch of the sound emission is changed from the starting point toward "C4 target".

Next, as for the key press of "E4 note", the pitch of the sound emission is changed toward "E4 target" from the starting point of the key press of the E4 note whose pitch is higher than the pitch of the C1 note, that is, the current pitch already heading toward "C4 target". Next, as for the key press of "G4 note", the pitch of the sound emission is changed toward "G4 target" from the starting point of the key press of the G4 note whose pitch is higher than the pitch of the second note, that is, the current pitch already heading toward "E4 target". In these pitch changes, three constitutive notes ("C4 note", "E4 note", and "G4 note") make the same pitch change, as depicted in FIG. 6. Therefore, there is no pitch difference among the constitutive notes, whereby the harmonic feeling is lost.

In order to address this problem, a technique has been suggested in which a plurality of previous key-press pitches are retained as history and, when a plurality of keys are simultaneously pressed, not only the latest key-press pitch but also the key-press pitch immediately before the latest key-press pitch and the key-press pitch before this key-press pitch are allocated to other starting points, whereby the harmonic feeling is kept during the pitch change (sound emission with portamento). This technique is described with reference to FIG. 7.

In FIG. 7, when a chord performance of "F minor" has been previously performed by pressing the keys of constitutive notes "C1 note", "F1 note", and "Ab1 note" in sequence, if a chord performance of "C major" is currently performed by pressing the keys of constitutive notes "C4 note", "E4 note", and "G4 note" in sequence, first, the immediately-preceding key-press pitch of "Ab1 note" is taken as a starting point for the key press of "C4 note", and the pitch of the sound emission is changed from the starting point toward "C4 target".

Next, as for the key press of "E4 note", the pitch of the second preceding key press, that is, "F1 note" is taken as a starting point, and the pitch of the sound emission is changed from the starting point toward "E4 target", on condition that the musical sound whose pitch is changing in response to the key press of "C4 note" has not reached "C4 target". Moreover, as for the key press of "G4 note", the pitch of the third preceding key press, that is, "C1 note" is taken as a starting point, and the pitch of the sound emission is changed from the starting point toward "G4 target", on condition that none of the musical sounds whose pitches are changing in response to the key pressing on "C4 note" and "E4 note" have reached "C4 target" and "E4 target".

By these pitch changes, pitch differences occur among the constitutive notes and whereby a harmonic feeling can be acquired. However, even when the chord performance of "C major" is currently performed by pressing the keys of the constitutive notes "C4 note", "E4 note", and "G4 note" almost simultaneously, the pitch differences among the constitutive notes during the pitch changes represent a minor chord, that is, F minor of C1/G1/Ab1.

That is, even when a major chord is played, the pitch is changed with a minor chord. Such change is a harmonically unfavorable detriment. Also, if the chord performance of "C major" is performed such that each note is individually played, or in other words, if the chord is played such that the keys of the constitutive notes "C4 note", "E4 note", and "G4 note" are pressed in sequence at predetermined time intervals, the pitch differences among the constitutive notes during the pitch changes causes dissonance, and the harmonic feeling is disadvantageously lost, as depicted in FIG. 8.

Thus, in short, there is a problem in the polyphonic portamento based on the above-described technique in that a pitch change cannot be made with pitch differences among constitutive notes of a played chord being maintained.

SUMMARY OF THE INVENTION

The present invention has been conceived in light of the above-described problems. An object of the present invention is to provide a musical sound emission apparatus, an electronic musical instrument, a musical sound emitting method, and a storage medium capable of actualizing polyphonic portamento by which a pitch change can be made with pitch differences among constitutive notes of a played chord being maintained.

In order to achieve the above-described object, in accordance with one aspect of the present invention, there is provided a musical sound emission apparatus comprising: a target pitch setting section which sets, every time a pitch specifying operation is performed, a pitch specified by the pitch specifying operation as a target pitch; a judging section which judges whether a musical sound generated in a sound source based on a pitch specified by an immediately-preceding pitch specifying operation performed before the pitch specifying operation is being emitted with portamento; a first starting-point pitch setting section which sets, as starting-point pitch, a pitch determined based on a relation among the target pitch, the pitch specified by the immediately-preceding pitch specifying operation, a pitch specified by a second preceding pitch specifying operation performed before the pitch specifying operation, and the pitch of the musical sound being emitted with portamento, when the judging section judges that the musical sound is being emitted with portamento; and a portamento sound emitting section which causes the sound source to emit the musical sound with portamento by taking the set starting-point pitch as a sound-emission start pitch and making a continuous pitch change toward the set target pitch.

In accordance with another aspect of the present invention, there is provided a musical sound emitting method comprising: a step of setting, every time a pitch specifying operation is performed, a pitch specified by the pitch specifying operation as a target pitch; a step of judging whether a musical sound generated in a sound source based on a pitch specified by an immediately-preceding pitch specifying operation performed before the pitch specifying operation is being emitted with portamento; a step of setting, as a starting-point pitch, a pitch determined based on a relation among the target pitch, the pitch specified by the immediately-preceding pitch specifying operation, a pitch specified by a second preceding pitch specifying operation performed before the pitch specifying operation, and the pitch of the musical sound being emitted with portamento, when the musical sound is judged to have been emitted with portamento; and a step of causing the sound source to emit the musical sound with portamento by taking the set starting-point pitch as a sound-emission start pitch and making a continuous pitch change toward the set target pitch.

In accordance with another aspect of the present invention, there is provided a non-transitory computer-readable storage medium having stored thereon a program that is executable by a computer for use as a musical sound emission apparatus, the program being executable by the computer to perform functions comprising: processing for setting, every time a pitch specifying operation is performed, a pitch specified by the pitch specifying operation as a target pitch; processing for judging whether a musical sound generated in a sound source based on a pitch specified by an immediately-preceding pitch specifying operation performed before the pitch specifying operation is being emitted with portamento; processing for setting, as a starting-point pitch, a pitch determined based on a relation among the target pitch, the pitch specified by the immediately-preceding pitch specifying operation, a pitch specified by a second preceding pitch specifying operation performed before the pitch specifying operation, and the pitch of the musical sound being emitted with portamento, when the musical sound is judged to have been emitted with portamento; and processing for causing the sound source to emit the musical sound with portamento by taking the set starting-point pitch as a sound-emission start pitch and making a continuous pitch change toward the set target pitch.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENT

Hereafter, an embodiment of the present invention is described with reference to the drawings.

A. Structure

Figure 1:
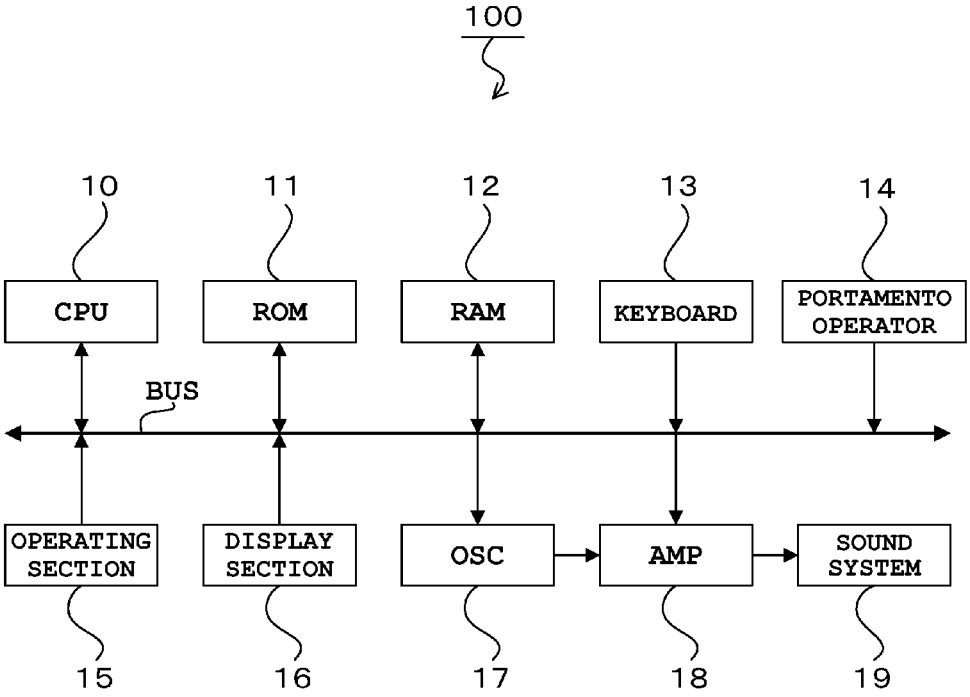
FIG. 1 is a block diagram showing the entire structure of a musical sound emission apparatus 100 according to an embodiment of the present invention.

FIG. 1 is a block diagram showing the entire structure of a musical sound emission apparatus 100 according to an embodiment of the present invention. A CPU 10 in FIG. 1 specifies an operation mode of each section in response to the operation of various switches arranged on an operating section 15, and instructs a waveform generator (oscillator: OSC) 17 and an amplifier (AMP) 18 to generate a musical sound according to musical performance information outputted from a keyboard 13. The CPU 10 also performs key-press event processing described below so as to actualize polyphonic portamento by which a pitch change can be made with pitch differences among constitutive notes of a played chord being maintained. The key-press event processing to be performed by the CPU 10 will be described in detail further below.

A ROM 11 in FIG. 1 has stored therein various programs to be executed by the CPU 10. These programs include a program for the key-press event processing described below. A RAM 12 in FIG. 1 is used as a work area of the CPU 10, and temporarily stores various registers and flag data. These registers include a key-press register for storing and retaining a plurality of key-press pitches performed in the past and sound-emission status (such as whether sound emission is portamento sound emission) as history.

The keyboard 13 generates musical performance information including a key-on/key-off event, a note number (or key number), and a velocity in accordance with a key-press/release operation (musical performance operation), and supplies the musical performance information to the CPU 10. A portamento operator 14 in FIG. 1 generates a parameter for controlling a portamento speed in accordance with a user operation. In the present embodiment, the portamento operator 14 generates a parameter indicating a certain portamento speed.

The operating section 15, which has various switches arranged on an operation panel, generates a switch event according to the type of an operated switch and supplies the switch event to the CPU 10. A display section 16 in FIG. 1 is constituted by an LCD panel or the like, and displays the setting status and operation status of each section in accordance with a display control signal supplied from the CPU 10. The waveform generator (OSC) 17 is structured as a known waveform memory reading type, and outputs waveform data in accordance with a musical sound command supplied from the CPU 10. For example, when a note-on command including a note number is received from the CPU 10, the waveform generator 17 reads waveform data stored therein at a reading speed corresponding to the note number and outputs its waveform.

The amplifier (AMP) 18 multiplies waveform data supplied from the above-described waveform generator 17 by sound-volume envelope waveform generated by the CPU 10 based on a velocity included in musical performance information, and thereby generates musical sound waveform data. A sound system 19 in FIG. 1 converts musical sound waveform data outputted from the amplifier 18 to an analog musical sound signal, performs filtering such as removing unwanted noise from the musical sound signal, amplifies the level of the musical sound signal, and emits it from a loudspeaker.

B. Operation

Next, the operations of key-press event processing, first starting-point processing, and second starting-point processing to be performed by the CPU 10 of the musical sound emission apparatus 100 having the above-described structure are described with reference to FIG. 2 to FIG. 5, respectively.

In the portamento in the present embodiment, a pitch change is continuously made to a pitch currently specified by a key press from a pitch specified by a key press immediately before the currently specified pitch. This operation is performed on condition that a previously-pressed key has not been released when a current key press is performed. Accordingly, the flowcharts below are described on the assumption that an immediately-preceding key-press pitch and a current pitch are not the same.

(1) Operation of Key-Press Event Processing

Figure 2:
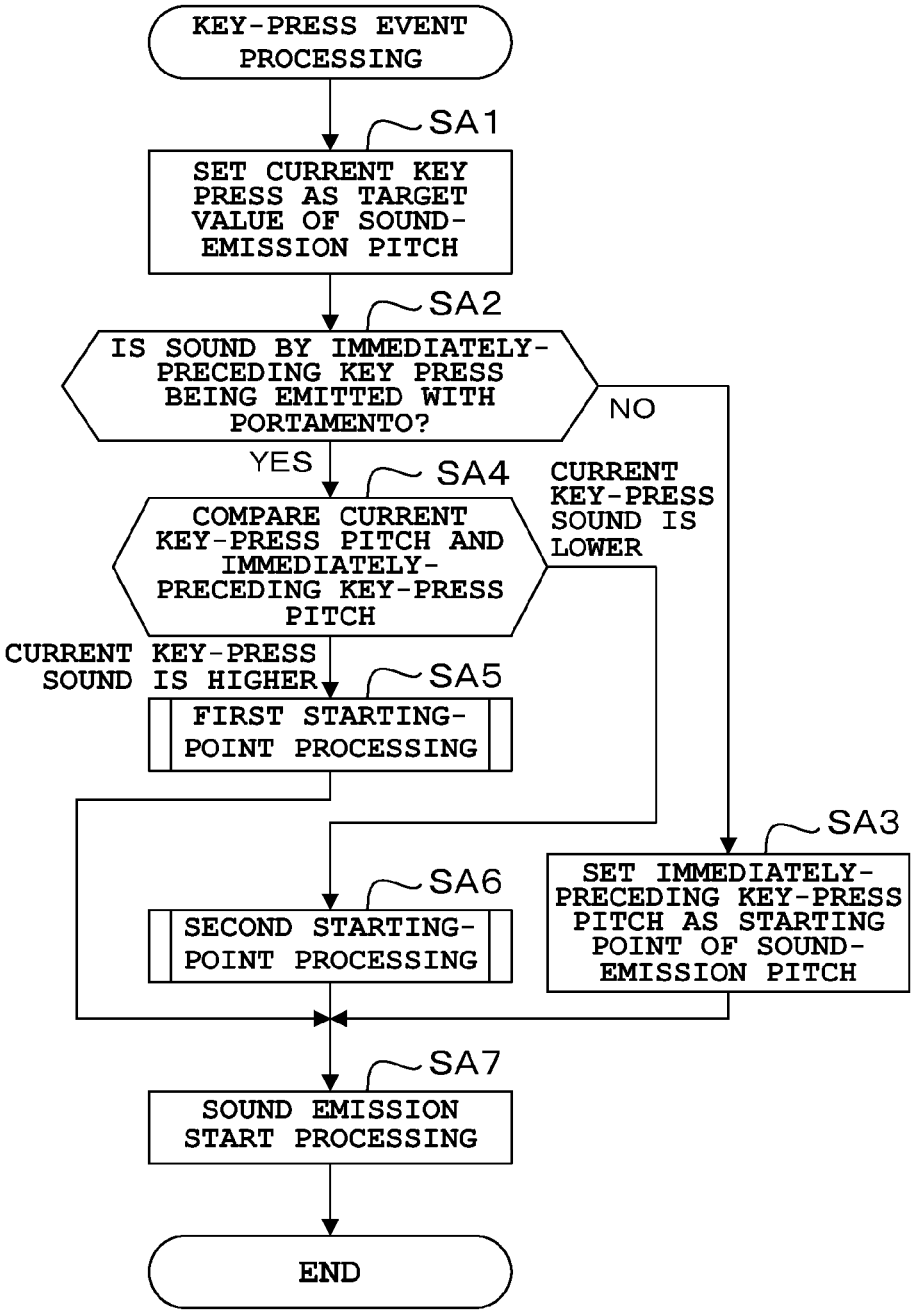
FIG. 2 is a flowchart of the operation of key-press event processing.

FIG. 2 is a flowchart of the operation of key-press event processing. The key-press event processing is started when the keyboard 13 generates musical performance information (key-on signal, note number, and velocity) in response to a key-press operation. When this processing is started, the CPU 10 proceeds to Step SA1 depicted in FIG. 2 and sets the pitch of a key (hereinafter abbreviated as a key-press pitch) currently pressed at a target value.

Subsequently, at Step SA2, the CPU 10 judges whether a sound generated by the immediately-preceding key press is being emitted with portamento. Note that the status of the sound emission based on the immediately-preceding key press judged based on history details registered in a key-press resister included in the RAM 12. When the sound generated by the immediately-preceding key press is not being emitted with portamento, since the judgment result at Step SA2 is "NO", the CPU 10 proceeds to Step SA3 and sets the immediately-preceding key-press pitch as a starting point of a sound-emission pitch (target value) for the current key press. Subsequently, the CPU 10 proceeds to Step SA7 and performs sound-emission start processing for instructing the waveform generator (OSC) 17 and the amplifier (AMP) 18 to emit a musical sound whose pitch changes from the starting point for the current key press to the target value. Then, the CPU 10 ends the processing. On the other hand, when the sound generated by the immediately-preceding key press is being emitted with portamento, the judgment result at Step SA2 is "YES", and therefore the CPU 10 proceeds to Step SA4. At Step SA4, the CPU 10 compares the current key-press pitch and the immediately-preceding key-press pitch. When the current key-press pitch is higher, the CPU 10 proceeds to Step SA5 and performs first starting-point processing for determining a starting point of sound emission for the current key press.

As will be described below, in the first starting-point processing, the CPU 10 compares the current key-press pitch and the second preceding key-press pitch and, when the current key-press pitch is higher than the second preceding key-press pitch, the CPU 10 judges whether the pitch of the musical sound being emitted with portamento is rising. When the pitch of the musical sound being emitted with portamento is falling, the CPU 10 sets the pitch of the musical sound being emitted with portamento as a starting point. Conversely, when the pitch of the musical sound being emitted is rising, the CPU 10 adds a pitch difference between the current key-press pitch and the immediately-preceding key-press pitch to the pitch of the musical sound being emitted with portamento, and sets the resultant pitch obtained by the addition as a starting point.

By contrast, when the current key-press pitch is lower than the second preceding key-press pitch, the CPU 10 compares the pitch of the musical sound being emitted with portamento and the target value. When the target value is higher, the CPU 10 sets the pitch of the musical sound being emitted with portamento as a starting point. Conversely, when the target value is lower, the CPU 10 adds a pitch difference between the current key-press pitch and the immediately-preceding key-press pitch to the pitch of the musical sound being emitted with portamento, and sets the resultant pitch obtained by the addition as a starting point.

Then, when the starting point of sound emission by the current key press is set by the first starting-point processing, the CPU 10 proceeds to Step SA7 and performs sound-emission start processing for instructing the waveform generator (OSC) 17 and the amplifier (AMP) 18 to change the pitch from the starting point for the current key press to the target value.

At Step SA4, when the current key-press pitch is lower as a result of the comparison between the current key-press pitch and the immediately-preceding key-press pitch, the CPU 10 proceeds to Step SA6 and performs second starting-point processing for determining a starting point of sound emission for the current key press.

As will be described below, in the second starting-point processing, the CPU 10 compares the current key-press pitch and the second preceding key-press pitch. When the current key-press pitch is higher, the CPU 10 compares the pitch of the musical sound being emitted with portamento and the target value. When the target value is lower, the CPU 10 sets the pitch of the musical sound being emitted with portamento as a starting point. Conversely, when the target value is higher, the CPU 10 subtracts a pitch difference between the current key-press pitch and the immediately-preceding key-press pitch from the pitch of the musical sound being emitted with portamento, and sets the resultant pitch obtained by the subtraction as a starting point.

By contrast, when the current key-press pitch is lower than the second preceding key-press pitch, the CPU 10 judges whether the pitch of the musical sound being emitted with portamento is rising. When the pitch of the musical sound being emitted with portamento is rising, the CPU 10 sets the pitch of the musical sound being emitted with portamento as a starting point Conversely, when the pitch of the musical sound being emitted with portamento is falling, the CPU 10 subtracts a pitch difference between the current key-press pitch and the immediately-preceding key-press pitch from the pitch of the musical sound being emitted with portamento, and sets the resultant pitch obtained by the subtraction as a starting point.

Then, when the starting point of sound emission by the current key press is set by the second starting-point processing, the CPU 10 proceeds to Step SA7 and performs sound-emission start processing for instructing the waveform generator (OSC) 17 and the amplifier (AMP) 18 to emit a musical sound whose pitch changes from the starting point for the current key press to the target value.

(2) Operation of First Starting-Point Processing

Figure 3:
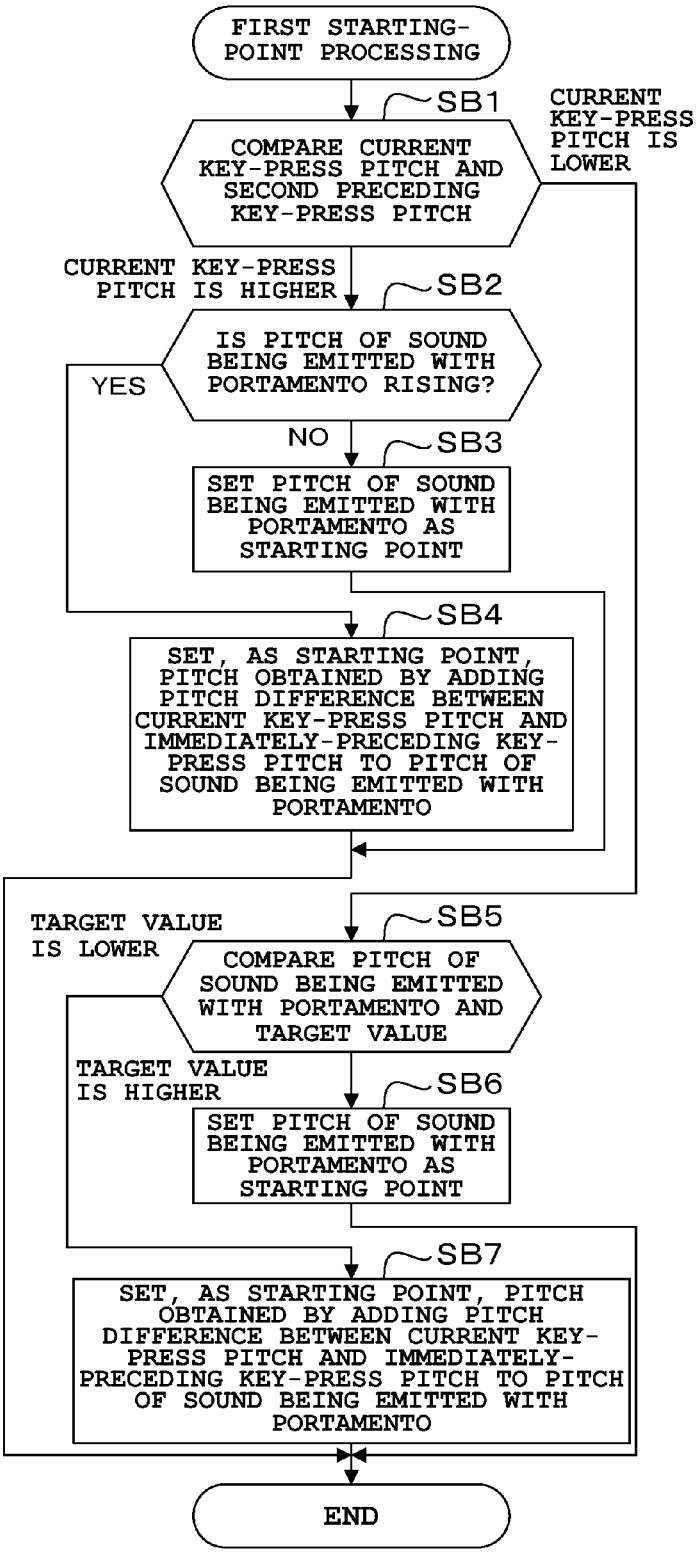
FIG. 3 is a flowchart of the operation of first starting-point processing.

Next, the operation of the first starting-point processing is described with reference to FIG. 3. When this processing is started via Step SA5 of the above-described key-press event processing, the CPU 10 proceeds to Step SB1 in FIG. 3 and compares the current key-press pitch and the second preceding key-press pitch. In the following descriptions, the operation is described for each of the case in which the current key-press pitch is higher and the case in which the current key-press pitch is lower.

a. When Current Key-Press Pitch is Higher than Second Preceding Key-Press Pitch

In this case, the CPU 10 proceeds to Step SB2 via Step SB1 and judges whether the pitch of the musical sound being emitted with portamento is rising. When the pitch of the musical sound being emitted with portamento is falling, the CPU 10 proceeds to Step SB3 via the Step SB2, sets the pitch of the musical sound being emitted with portamento as a starting point, and ends the processing.

Conversely, when the pitch of the musical sound being emitted with portamento is rising, the CPU 10 proceeds to Step SB4 via Step SB2, adds a pitch difference between the current key-press pitch and the immediately-preceding key-press pitch to the pitch of the musical sound being emitted with portamento, sets the resultant pitch obtained by the addition as a starting point, and ends the processing.

b. When Current Key-Press Pitch is Lower than Second Preceding Key-Press Pitch

In this case, the CPU 10 proceeds to Step SB5 via Step SB1 and compares the pitch of the musical sound being emitted with portamento and the target value. When the target value is higher, the CPU 10 proceeds to Step SB6 via Step SB5, sets the pitch of the musical sound being emitted with portamento as a starting point, and ends the processing.

Conversely, when the target value is lower, the CPU 10 proceeds to Step SB7 via Step SB5, adds a pitch difference between the current key-press pitch and the immediately-preceding key-press pitch to the pitch of the musical sound being emitted with portamento, sets the resultant pitch obtained by the addition as a starting point, and ends the processing.

As such, in the first starting-point processing, the CPU 10 compares the current key-press pitch and the second preceding key-press pitch. When the current key-press pitch is higher than the second preceding key-press pitch, the CPU 10 judges whether the pitch of the musical sound being emitted with portamento is rising. Then, when the pitch of the musical sound being emitted with portamento is falling, the CPU 10 sets the pitch of the musical sound being emitted with portamento as a starting point. Conversely, when the pitch of the musical sound being emitted with portamento is rising, the CPU 10 adds a pitch difference between the current key-press pitch and the immediately-preceding key-press pitch to the pitch of the musical sound being emitted with portamento, and sets the resultant pitch obtained by the addition as a starting point.

By contrast, when the current key-press pitch is lower than the second preceding key-press pitch, the CPU 10 compares the pitch of the musical sound being emitted with portamento and the target value. When the target value is higher, the CPU 10 sets the pitch of the musical sound being emitted with portamento as a starting point. Conversely, when the target value is lower, the CPU 10 adds a pitch difference between the current key-press pitch and the immediately-preceding key-press pitch to the pitch of the musical sound being emitted with portamento, and sets the resultant pitch obtained by the addition as a starting point.

(3) Operation of Second Starting-Point Processing

Figure 4:
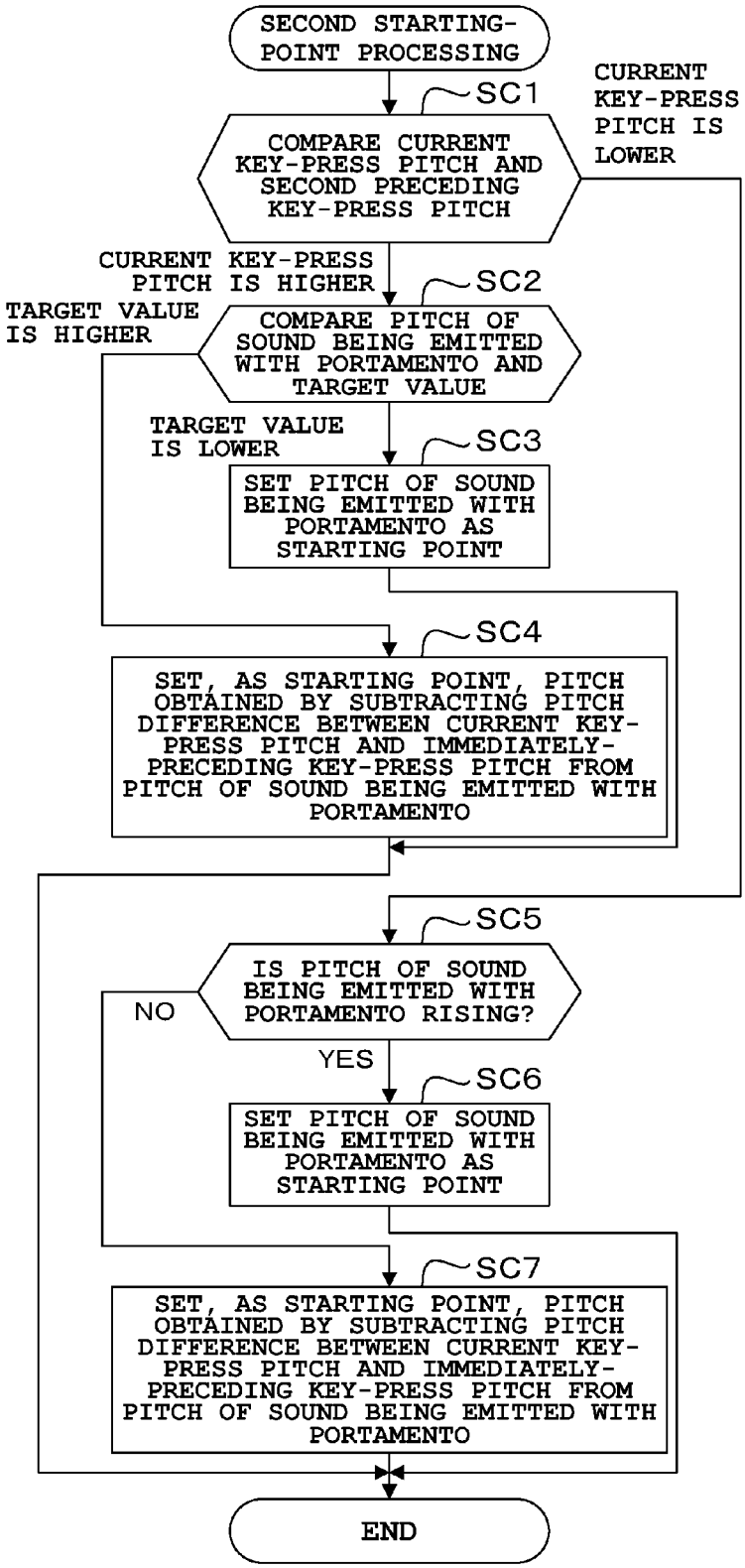
FIG. 4 is a flowchart of the operation of second starting-point processing.

Next, the operation of the second starting-point processing is described with reference to FIG. 4. When this processing is started via Step SA6 of the above-described key-press event processing, the CPU 10 proceeds to Step SC1 in FIG. 4 and compares the current key-press pitch and the second preceding key-press pitch. In the following descriptions, the operation is described for each of the case in which the current key-press pitch is higher and the case in which the current key-press pitch is lower.

a. When Current Key-Press Pitch is Higher than Second Preceding Key-Press Pitch

In this case, the CPU 10 proceeds to Step SC2 via Step SC1 and compares the pitch of the musical sound being emitted with portamento and the target value. When the target value is lower, the CPU 10 proceeds to Step SC3 via Step SC2, sets the pitch of the musical sound being emitted with portamento as a starting point, and end the processing.

Conversely, when the target value is higher, the CPU 10 proceeds to Step SC4 via Step SC2, subtracts a pitch difference between the current key-press pitch and the immediately-preceding key-press pitch from the pitch of the musical sound being emitted with portamento, sets the resultant pitch obtained by the subtraction as a starting point, and ends the processing.

b. When Current Key-Press Pitch is Lower than Second Preceding Key-Press Pitch

In this case, the CPU 10 proceeds to Step SC5 via Step SC1 and judges whether the pitch of the musical sound being emitted with portamento is rising. When the pitch of the musical sound being emitted with portamento is rising, since the judgment result is "YES", the CPU 10 proceeds to Step SC6, sets the pitch of the musical sound being emitted with portamento as a starting point, and ends the processing.

Conversely, when the pitch of the musical sound being emitted with portamento is falling, since the judgment result at Step SC5 is "NO", the CPU 10 proceeds to Step SC7, subtracts a pitch difference between the current key-press pitch and the immediately-preceding key-press pitch from the pitch of the musical sound being emitted with portamento, sets the resultant pitch obtained by the subtraction as a starting point, and ends the processing.

As such, in the second starting-point processing, the CPU 10 compares the current key-press pitch and the second preceding key-press pitch. When the current key-press pitch is higher than the second preceding key-press pitch, the CPU 10 compares the pitch of the musical sound being emitted with portamento and the target value. Then, when the target value is lower, the CPU 10 sets the pitch of the musical sound being emitted with portamento as a starting point. Conversely, when the target value is higher, the CPU 10 subtracts a pitch difference between the current key-press pitch and the immediately-preceding key-press pitch from the pitch of the musical sound being emitted with portamento, and sets the resultant pitch obtained by the subtraction as a starting point.

By contrast, when the current key-press pitch is lower than the second preceding key-press pitch, the CPU 10 judges whether the pitch of the musical sound being emitted with portamento is rising. When the pitch of the musical sound being emitted with portamento is rising, the CPU 10 sets the pitch of the musical sound being emitted with portamento as a starting point. Conversely, when the pitch of the musical sound being emitted with portamento is falling, the CPU 10 subtracts a pitch difference between the current key-press pitch and the immediately-preceding key-press pitch from the pitch of the musical sound being emitted with portamento, and sets the resultant pitch obtained by the subtraction as a starting point.

(4) Description of Specific Operation

Figure 5:
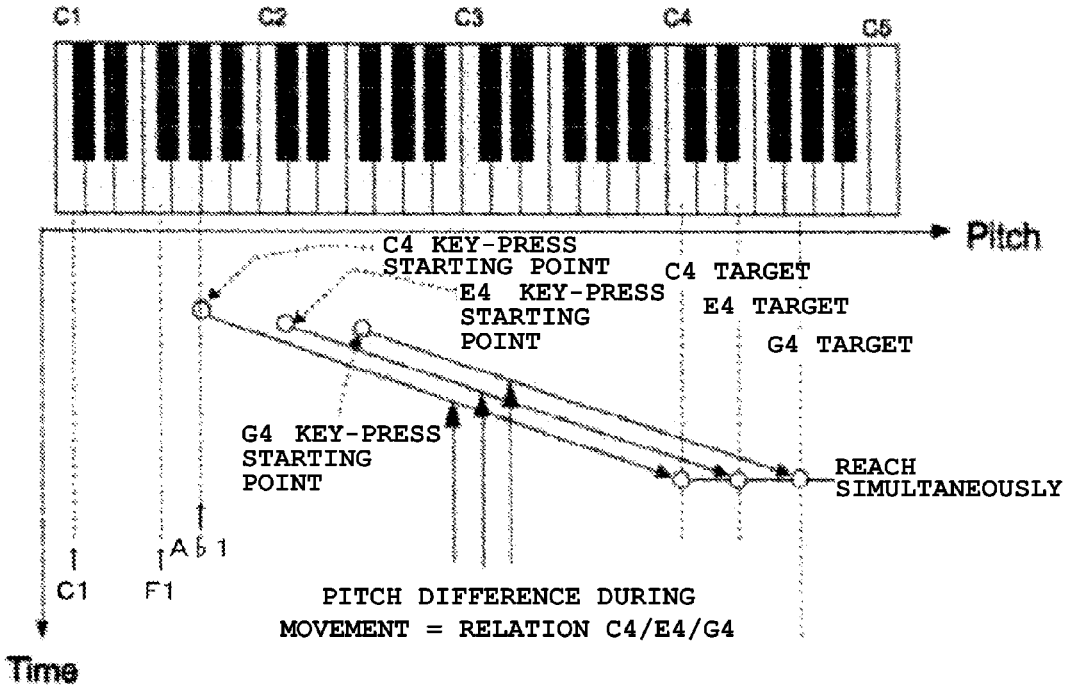
FIG. 5 is a diagram showing an example of a polyphonic portamento operation actualized by the key-press event processing.
Figure 6:
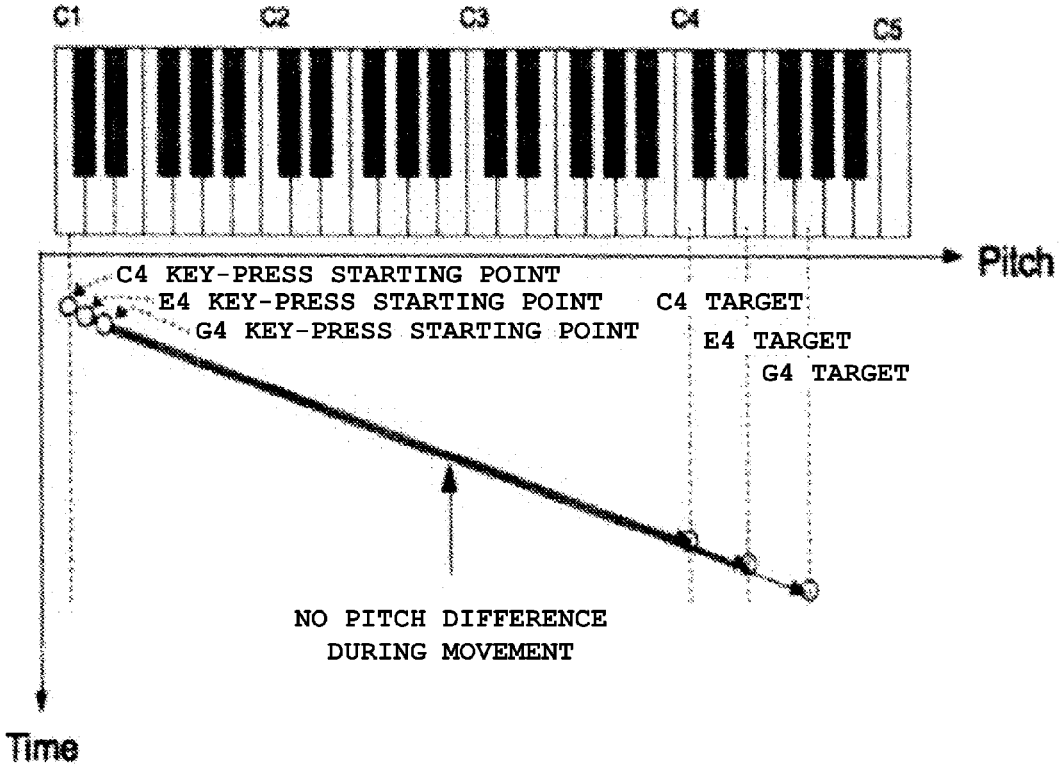
FIG. 6 is a diagram for describing prior art.
Figure 7:
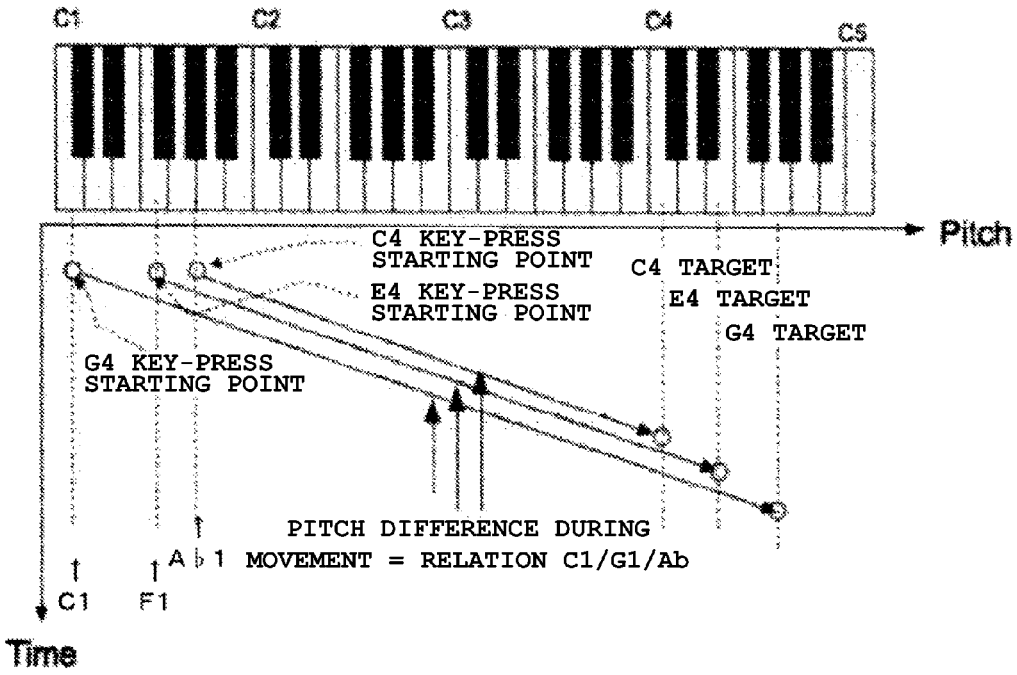
FIG. 7 is a diagram for describing prior art.
Figure 8:
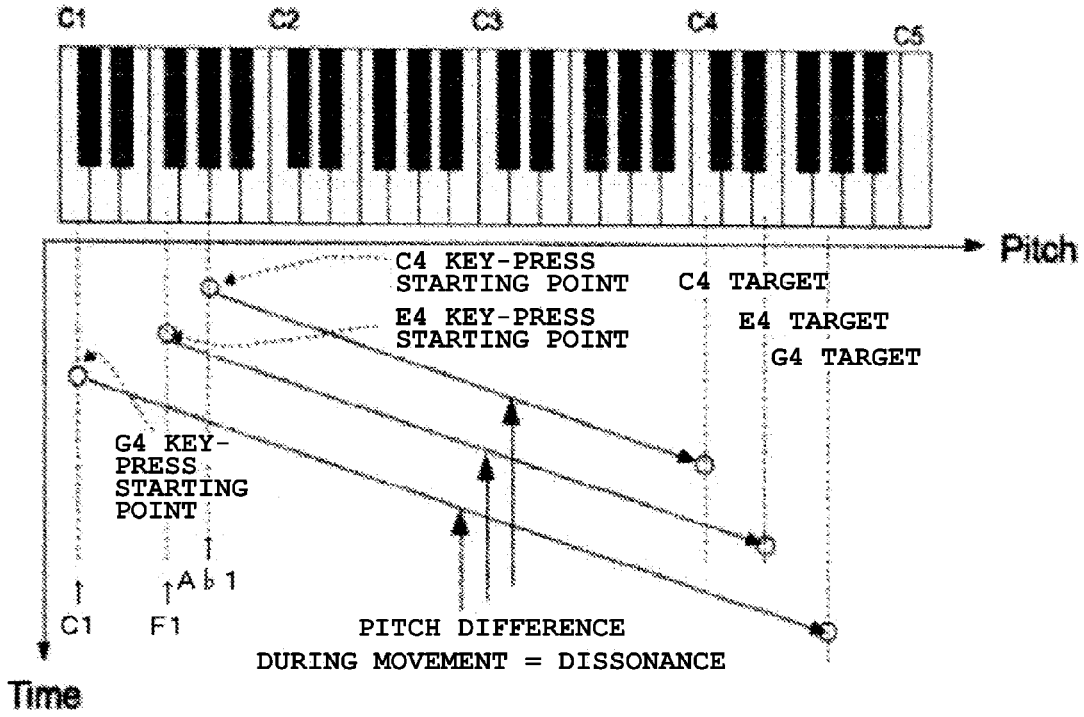
FIG. 8 is a diagram for describing prior art.

Next, a specific operation of key-press event processing is described with reference to FIG. 5. FIG. 5 is a diagram showing the positions of previous key pressing (previous chord performance) on the keyboard, the positions of current key pressing (current chord performance) thereon, the previous key-press timing, and the current key-press timing, in which a chord performance of "F minor" has been previously performed by the keys of constitutive notes "C1 note", "F1 note", and "Ab1 note" being pressed in sequence, and a chord performance of "C major" is currently being performed by the keys of constitutive notes "C4 note", "E4 note", and "G4 note" being pressed in sequence.

In the following descriptions, a specific operation of the key-press event processing is described using the above-mentioned example. First, as for the first key press of "C4 note", the immediately-preceding key-press pitch of "Ab1 note" is taken as a starting point of the C4 key press, and the pitch is changed from the starting point toward "C4 target".

Next, as for the key press of "E4 note", a pitch difference between the current key-press pitch of "E4 note" and the immediately-preceding key-press pitch of "C4 note" is added to the pitch of the musical sound being emitted with portamento (sound toward "C4 target"), the resultant pitch obtained by the addition is taken as a starting point of the E4 key press, and the pitch is changed from the starting point toward "E4 target".

Also, as for the key press of "G4 note", a pitch difference between the current key-press pitch of "G4 note" and the immediately-preceding key-press pitch of "E4 note" is added to the pitch of the musical sound being emitted with portamento (sound toward "E4 target"), the resultant pitch obtained by the addition is taken as a starting point of the G4 key press, and the pitch is changed from the starting point toward "G4 target".

Accordingly, the pitch differences among the constitutive notes during the pitch change are C4/E4/G4, so that the pitch of the currently performed chord performance of "C major" is changed with its major chord maintained. As a result, polyphonic portamento is actualized in which a pitch change is made with pitch differences among constitutive notes of a performed chord being maintained.

As described above, in the present embodiment, the pitches and sound-emission status of at least first to third current key presses and a key press immediately before the first current key press in a current chord performance are stored. Next, the pitch of the first current key press is set as a first target value and, if the sound of the pitch of the key press immediately before the first current key press is not being emitted, the pitch of the immediately-preceding key press is set as a first starting point. Then, the sound of the pitch of the first current key press is emitted from the first starting point toward the first target value.

Next, the pitch of the second current key press is set as a second target value and, if the sound of the pitch of the first current key press is being emitted with portamento, the pitch of the second current key press and the pitch of the first current key press are compared. Here, when the pitch of the second current key press is higher, the pitch of the second current key press and the pitch of the key press immediately before the first current key press are compared. Then, when the pitch of the second current key press is higher, it is judged whether the pitch of the musical sound being emitted with portamento toward the first target value is rising. Here, when the pitch of the musical sound being emitted with portamento is rising, a pitch difference between the pitch of the second current key press and the pitch of the first current key press is added to the pitch of the musical sound being emitted with portamento toward the first target value, and the resultant value is set as a second starting point. Then, the sound of the pitch of the second current key press is emitted from the second starting point toward the second target value.

Moreover, the pitch of the third current key press is set as a third target value and, if the sound of the pitch of the second current key press is being emitted with portamento, the pitch of the third current key press and the pitch of the second current key press are compared. Here, when the pitch of the third current key press is rising, the pitch of the third current key press and the pitch of the first current key press are compared. Then, when the pitch of the third current key press is higher, it is judged whether the pitch of the musical sound being emitted with portamento toward the second target value is rising. Here, when the pitch of the musical sound being emitted with portamento is rising, a pitch difference between the pitch of the third current key press and the pitch of the second current key press is added to the pitch of the musical sound being emitted with portamento toward the second target value, and the resultant value is set as a third starting point. Then, the sound of the pitch of the third current key press is emitted with portamento from the third starting point toward the third target value.

Accordingly, the pitch differences among the constitutive notes during the pitch change are the pitch of the first key press/the pitch of the second key press/the pitch of the third key press, so that polyphonic portamento is actualized in which a pitch change is made with pitch differences among constitutive notes of a performed chord (the first to third current key presses) being maintained.

In the above embodiment, polyphonic portamento with triads has been described. However, the gist of the present invention is not limited thereto, and the present invention can be applied to tetrads (seventh chords) and pentads (tension chords). Also, the present invention can be applied to broken chords (arpeggio) where chord components are emitted not simultaneously but in sequence.

While the present invention has been described with reference to the preferred embodiments, it is intended that the invention be not limited by any of the details of the description therein but includes all the embodiments which fall within the scope of the appended claims.

What is claimed is:

1. A musical sound emission apparatus comprising:

a target pitch setting section which sets, every time a pitch specifying operation is performed, a pitch specified by the pitch specifying operation as a target pitch;

a judging section which judges whether a musical sound generated in a sound source based on a pitch specified by an immediately-preceding pitch specifying operation performed before the pitch specifying operation is being emitted with portamento;

a first starting-point pitch setting section which sets, as a starting-point pitch, a pitch determined based on a relation among the target pitch, the pitch specified by the immediately-preceding pitch specifying operation, a pitch specified by a second preceding pitch specifying operation performed before the pitch specifying operation, and the pitch of the musical sound being emitted with portamento, when the judging section judges that the musical sound is being emitted with portamento; and a portamento sound emitting section which causes the sound source to emit the musical sound with portamento by taking the set starting-point pitch as a sound-emission start pitch and making a continuous pitch change toward the set target pitch.

2. The musical sound emission apparatus according to claim 1, wherein the first starting-point pitch setting section sets, as the starting-point pitch, a pitch obtained by adding a difference between the target pitch and the pitch specified by the immediately-preceding pitch specifying operation to the pitch of the musical sound being emitted with portamento, when the target pitch is judged to be higher than the pitch specified by the immediately-preceding pitch specifying operation and the pitch specified by the second preceding pitch specifying operation performed before the pitch specifying operation, and the pitch of the musical sound being emitted from the sound source with portamento is rising; or sets the pitch of the musical sound being emitted with portamento as the starting-point pitch, when the pitch of the musical sound being emitted with portamento is not rising.

3. The musical sound emission apparatus according to claim 1, wherein the first starting-point pitch setting section sets, as the starting-point pitch, a pitch obtained by adding a difference between the target pitch and the pitch specified by the immediately-preceding pitch specifying operation to the pitch of the musical sound being emitted with portamento, when the target pitch is judged to be higher than the pitch specified by the immediately-preceding pitch specifying operation and lower than the pitch specified by the second preceding pitch specifying operation performed before the pitch specifying operation, and the pitch of the musical sound being emitted from the sound source with portamento is higher than the target pitch; or sets the pitch of the musical sound being emitted with portamento as the starting-point pitch, when the pitch of the musical sound being emitted with portamento is lower than the target pitch.

4. The musical sound emission apparatus according to claim 1, wherein the first starting-point pitch setting section sets, as the starting-point pitch, a pitch obtained by adding a difference between the target pitch and the pitch specified by the immediately-preceding pitch specifying operation to the pitch of the musical sound being emitted with portamento, when the target pitch is judged to be lower than the pitch specified by the immediately-preceding pitch specifying operation and the pitch specified by the second preceding pitch specifying operation performed before the pitch specifying operation, and the pitch of the musical sound being emitted from the sound source with portamento is not rising; or sets the pitch of the musical sound being emitted with portamento as the starting-point pitch, when the pitch of the musical sound being emitted with portamento is rising.

5. The musical sound emission apparatus according to claim 1, wherein the first starting-point pitch setting section sets, as the starting-point pitch, a pitch obtained by adding a difference between the target pitch and the pitch specified by the immediately-preceding pitch specifying operation to the pitch of the musical sound being emitted with portamento, when the target pitch is judged to be lower than the pitch specified by the immediately-preceding pitch specifying operation and higher than the pitch specified by the second preceding pitch specifying operation performed before the pitch specifying operation, and the pitch of the musical sound being emitted from the sound source with portamento is higher than the target pitch; or sets the pitch of the musical sound being emitted with portamento as the starting-point pitch, when the pitch of the musical sound being emitted with portamento is lower than the target pitch.

6. The musical sound emission apparatus according to claim 1, further comprising:

a second starting-point pitch setting section which sets the pitch specified by the immediately-preceding pitch specifying operation as the starting-point pitch, when the judging section judges that the musical sound is not being emitted with portamento.

7. An electronic musical instrument comprising:

the musical sound emission apparatus according to claim 1;

a plurality of pitch specifying operators; and a sound source which generates a musical sound with a pitch specified by one of the plurality of pitch specifying operators.

8. A musical sound emitting method comprising:

a step of setting, every time a pitch specifying operation is performed, a pitch specified by the pitch specifying operation as a target pitch;

a step of judging whether a musical sound generated in a sound source based on a pitch specified by an immediately-preceding pitch specifying operation performed before the pitch specifying operation is being emitted with portamento;

a step of setting, as a starting-point pitch, a pitch determined based on a relation among the target pitch, the pitch specified by the immediately-preceding pitch specifying operation, a pitch specified by a second preceding pitch specifying operation performed before the pitch specifying operation, and the pitch of the musical sound being emitted with portamento, when the musical sound is judged to have been emitted with portamento; and a step of causing the sound source to emit the musical sound with portamento by taking the set starting-point pitch as a sound-emission start pitch and making a continuous pitch change toward the set target pitch.

9. The musical sound emitting method according to claim 8, wherein a pitch obtained by adding a difference between the target pitch and the pitch specified by the immediately-preceding pitch specifying operation to the pitch of the musical sound being emitted with portamento is set as the starting-point pitch, when the target pitch is judged to be higher than the pitch specified by the immediately-preceding pitch specifying operation and the pitch specified by the second preceding pitch specifying operation performed before the pitch specifying operation, and the pitch of the musical sound being emitted from the sound source with portamento is rising; or the pitch of the musical sound being emitted with portamento is set as the starting-point pitch, when the pitch of the musical sound being emitted with portamento is not rising.

10. The musical sound emitting method according to claim 8, wherein a pitch obtained by adding a difference between the target pitch and the pitch specified by the immediately-preceding pitch specifying operation to the pitch of the musical sound being emitted with portamento is set as the starting-point pitch, when the target pitch is judged to be higher than the pitch specified by the immediately-preceding pitch specifying operation and lower than the pitch specified by the second preceding pitch specifying operation performed before the pitch specifying operation, and the pitch of the musical sound being emitted from the sound source with portamento is higher than the target pitch; or the pitch of the musical sound being emitted with portamento is set as the starting-point pitch, when the pitch of the musical sound being emitted with portamento is lower than the target pitch.

11. The musical sound emitting method according to claim 8, wherein a pitch obtained by adding a difference between the target pitch and the pitch specified by the immediately-preceding pitch specifying operation to the pitch of the musical sound being emitted with portamento is set as the starting-point pitch, when the target pitch is judged to be lower than the pitch specified by the immediately-preceding pitch specifying operation and the pitch specified by the second preceding pitch specifying operation performed before the pitch specifying operation, and the pitch of the musical sound being emitted from the sound source with portamento is not rising; or the pitch of the musical sound being emitted with portamento is set as the starting-point pitch, when the pitch of the musical sound being emitted with portamento is rising.

12. The musical sound emitting method according to claim 8, wherein a pitch obtained by adding a difference between the target pitch and the pitch specified by the immediately-preceding pitch specifying operation to the pitch of the musical sound being emitted with portamento is set as the starting-point pitch, when the target pitch is judged to be lower than the pitch specified by the immediately-preceding pitch specifying operation and higher than the pitch specified by the second preceding pitch specifying operation performed before the pitch specifying operation, and the pitch of the musical sound being emitted from the sound source with portamento is higher than the target pitch; or the pitch of the musical sound being emitted with portamento is set as the starting-point pitch, when the pitch of the musical sound being emitted with portamento is lower than the target pitch.

13. The musical sound emitting method according to claim 8, wherein the pitch specified by the immediately-preceding pitch specifying operation is set as the starting-point pitch, when the musical sound is judged to have not been emitted with portamento.

14. A non-transitory computer-readable storage medium having stored thereon a program that is executable by a computer for use as a musical sound emission apparatus, the program being executable by the computer to perform functions comprising:

processing for setting, every time a pitch specifying operation is performed, a pitch specified by the pitch specifying operation as a target pitch;

processing for judging whether a musical sound generated in a sound source based on a pitch specified by an immediately-preceding pitch specifying operation performed before the pitch specifying operation is being emitted with portamento;

processing for setting, as a starting-point pitch, a pitch determined based on a relation among the target pitch, the pitch specified by the immediately-preceding pitch specifying operation, a pitch specified by a second preceding pitch specifying operation performed before the pitch specifying operation, and the pitch of the musical sound being emitted with portamento, when the musical sound is judged to have been emitted with portamento; and processing for causing the sound source to emit the musical sound with portamento by taking the set starting-point pitch as a sound-emission start pitch and making a continuous pitch change toward the set target pitch.

15. The non-transitory computer-readable storage medium according to claim 14, wherein a pitch obtained by adding a difference between the target pitch and the pitch specified by the immediately-preceding pitch specifying operation to the pitch of the musical sound being emitted with portamento is set as the starting-point pitch, when the target pitch is judged to be higher than the pitch specified by the immediately-preceding pitch specifying operation and the pitch specified by the second preceding pitch specifying operation performed before the pitch specifying operation, and the pitch of the musical sound being emitted from the sound source with portamento is rising; or the pitch of the musical sound being emitted with portamento is set as the starting-point pitch, when the pitch of the musical sound being emitted with portamento is not rising.

16. The non-transitory computer-readable storage medium according to claim 14, wherein a pitch obtained by adding a difference between the target pitch and the pitch specified by the immediately-preceding pitch specifying operation to the pitch of the musical sound being emitted with portamento is set as the starting-point pitch, when the target pitch is judged to be higher than the pitch specified by the immediately-preceding pitch specifying operation and lower than the pitch specified by the second preceding pitch specifying operation performed before the pitch specifying operation, and the pitch of the musical sound being emitted from the sound source with portamento is higher than the target pitch; or the pitch of the musical sound being emitted with portamento is set as the starting-point pitch, when the pitch of the musical sound being emitted with portamento is lower than the target pitch.

17. The non-transitory computer-readable storage medium according to claim 14, wherein a pitch obtained by adding a difference between the target pitch and the pitch specified by the immediately-preceding pitch specifying operation to the pitch of the musical sound being emitted with portamento is set as the starting-point pitch, when the target pitch is judged to be lower than the pitch specified by the immediately-preceding pitch specifying operation and the pitch specified by the second preceding pitch specifying operation performed before the pitch specifying operation, and the pitch of the musical sound being emitted from the sound source with portamento is not rising; or the pitch of the musical sound being emitted with portamento is set as the starting-point pitch, when the pitch of the musical sound being emitted with portamento is rising.

18. The non-transitory computer-readable storage medium according to claim 14, wherein a pitch obtained by adding a difference between the target pitch and the pitch specified by the immediately-preceding pitch specifying operation to the pitch of the musical sound being emitted with portamento is set as the starting-point pitch, when the target pitch is judged to be lower than the pitch specified by the immediately-preceding pitch specifying operation and higher than the pitch specified by the second preceding pitch specifying operation performed before the pitch specifying operation, and the pitch of the musical sound being emitted from the sound source with portamento is higher than the target pitch; or the pitch of the musical sound being emitted with portamento is set as the starting-point pitch, when the pitch of the musical sound being emitted with portamento is lower than the target pitch.

19. The non-transitory computer-readable storage medium according to claim 14, wherein the pitch specified by the immediately-preceding pitch specifying operation is set as the starting-point pitch, when the musical sound is judged to have not been emitted with portamento.

* * * * *